United States Patent [19]

Loesch

[11] Patent Number: 4,464,879

[45] Date of Patent: Aug. 14, 1984

[54] METHODS OF AND APPARATUS FOR TRANSFERRING RETRACTILE CORDS

[75] Inventor: Robert P. Loesch, Omaha, Nebr.

[73] Assignee: AT&T Technologies, Inc., New York, N.Y.

[21] Appl. No.: 383,362

[22] Filed: May 28, 1982

[51] Int. Cl.[3] ..... B65B 5/04; B65B 63/04

[52] U.S. Cl. ..... 53/428; 29/753; 29/759; 29/857; 53/111 R; 53/116; 53/235; 53/429; 53/473; 198/486

[58] Field of Search ..... 53/111 R, 116, 120, 53/235, 244, 428, 429, 260, 261, 469, 473; 29/857, 866, 753, 759; 198/486

[56] References Cited

U.S. PATENT DOCUMENTS

| | | | |
|---|---|---|---|
| 3,214,880 | 11/1965 | Berg | 53/473 X |
| 3,439,469 | 4/1969 | Van Mil, Jr. | 53/21 |
| 3,704,565 | 12/1972 | Glaze, Jr. | 53/429 |
| 4,090,763 | 5/1978 | Congdon et al. | 339/103 M |
| 4,148,539 | 4/1979 | Hardesty | 339/97 R |
| 4,162,600 | 7/1979 | Westall et al. | 53/120 |

*Primary Examiner*—Robert L. Spruill
*Assistant Examiner*—Steven P. Weihrouch
*Attorney, Agent, or Firm*—E. W. Somers

[57] ABSTRACT

Retractile cords disposed in a U-shaped configuration are arranged about the periphery of a turntable with the ends of each cord adjacent to the peripheral edge being terminated with modular plugs. As a cord having its ends terminated with modular plugs is moved into a last work station, a pickup arm removes the cord. As the plug-ends are moved outwardly from the turntable, a middle section of the U-shaped cord is engaged by a snagging pin that is moved into one portion of a foldable tray to hold the middle section of the cord as the plug ends are moved farther along above the tray. The plugs are released, and the cord retracts and drops into the tray. Then the snagging pin is retracted, and the tray is caused to be folded to form an opening beween portions of the tray. The cord descends through the opening into an open end of a bag formed between two plies of a plastic material. The plies are bonded together adjacent to the open end and the bag is separated from its supply. For longer length cords, the movement of the plug ends is discontinued when they are in the other tray portion. As a result, when the tray is folded, the cord is doubled over prior to its movement into the bag.

20 Claims, 20 Drawing Figures

52
161
164
162
163
140
41
210

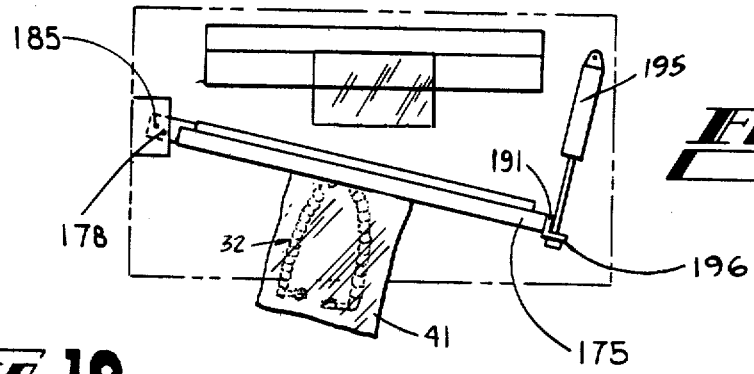
Fig_15C
Fig_10
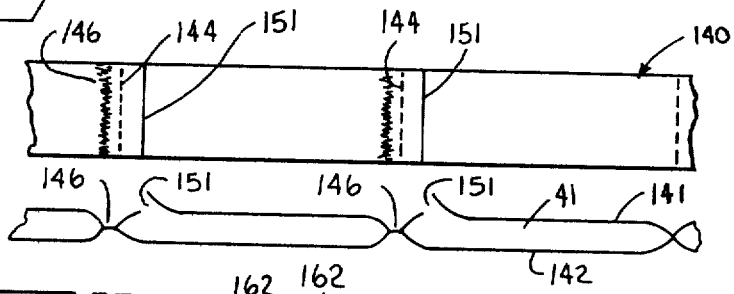
Fig_11
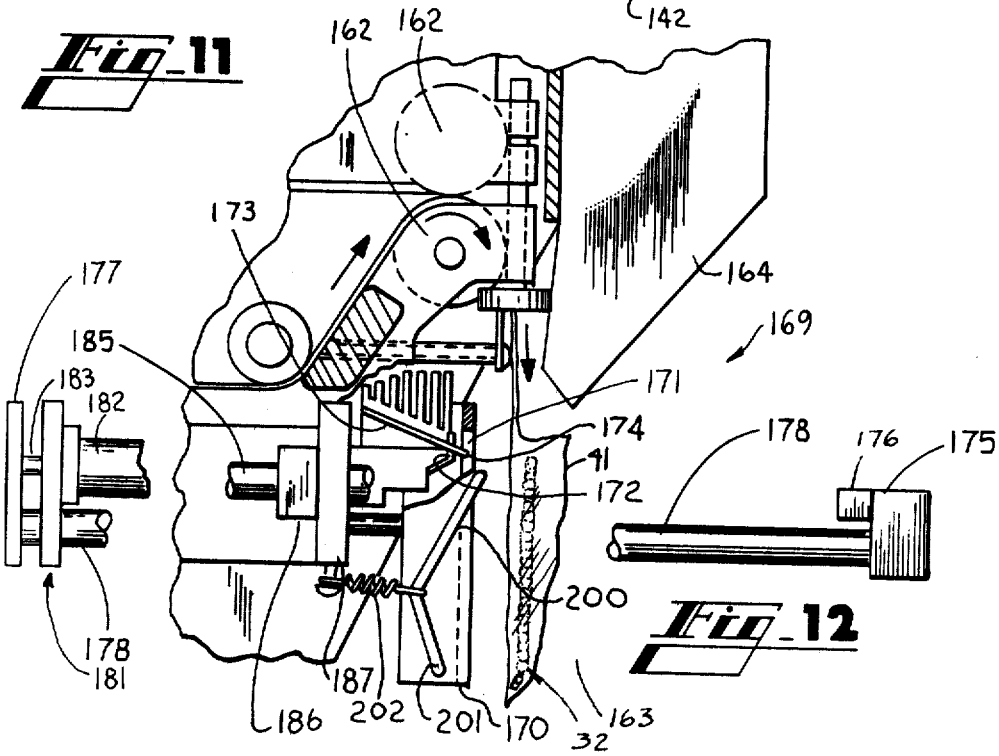
Fig_12

METHODS OF AND APPARATUS FOR TRANSFERRING RETRACTILE CORDS

TECHNICAL FIELD

This invention relates to methods of and apparatus for transferring retractile cords. More particularly, it relates to methods of and apparatus for removing plug-terminated retractile cords from terminating apparatus and for transferring the cords to apparatus which packages the cords in individual containers.

BACKGROUND OF THE INVENTION

Cords which interconnect portions of telephone station apparatus are generally retractile in form. These are well known in the art and are described, for example, in U.S. Pat. No. 4,090,763 which issued on May 23, 1978 in the names of W. T. Congdon et al. These cords are made available in several lengths and in a variety of colors. They are marketed through local outlets where they are purchased by customers who install them. Installation is facilitated by terminating the cords with modular plugs which are easily inserted into jacks in the station apparatus. Such plugs are shown, for example, in U.S. Pat. No. 4,148,539, which issued on Apr. 10, 1979 in the name of E. C. Hardesty.

The cords have been provided to customers in individual plastic bags. Each bag comprises two plies which are sealed along overlapping longitudinal and transverse edges. The packaging plastic is printed with instructions to the customer regarding the installation of the cord.

Manufacture of a cord includes the manufacture of individually insulated conductors as disclosed in above-identified U.S. Pat. No. 4,090,763 and the jacketing of a plurality of the conductors to form cordage. A length of cordage is wound in a plurality of convolutions on a mandrel, heat-set and removed from the mandrel while the direction of the helices is reversed.

Retractile cords so produced are loaded seriatim on a conveyor, such as a turntable, for example, with ends of each cord adjacent to the periphery of the turntable. As the turntable is indexed through a plurality of work stations, a modular plug is attached to each end of each cord which is disposed in a U-shape on the turntable. Then, a plurality of terminals in the form of blades are inserted into each plug and seated therein to cause tangs of the terminals to engage electrically conductors of the cord end that is terminated with the plug. Following their termination, the cords are removed from the turntable by a pickup device and loaded into receptacles.

The receptacles are moved to a work station where each is packaged by commercially available apparatus. One such apparatus for packaging cords includes means for supporting a roll of a strip of plastic material which includes two longitudinally extending plies that are sealed together along their longitudinal edges. The plies are sealed together transversely at spaced intervals and transverse openings are formed in one of the plies adjacent to each transverse end. Successive sections of the strip are advanced to a loading station. A jet of air directed toward each opening as it is presented to a loading position causes the separation of the plies to permit an operator to insert a cord. Then the plies adjacent to the opening are sealed together. The sealed package which has been loaded with a cord is separated from the strip along a line of perforations adjacent to the opening.

As should be apparent, the use of packaging facilities separate from the terminating apparatus requires additional handling which results in increased costs. It would be most desirable to be able to integrate the packaging as the last in the sequence of steps of manufacture associated with the turntable. This need has not been met by the prior art. To meet this need in its entirety requires the capability of packaging different lengths of retractile cords. Moreover, apparatus for meeting this need should be such that it is easily integrated with the apparatus for terminating the cords with modular plugs.

SUMMARY OF THE INVENTION

The foregoing needs have been met by the methods and apparatus of this invention. In a method of this invention, a retractile cord is transferred from a conveyor to an apparatus where it is packaged in a container. The retractile cord is positioned on a conveyor and is moved through a plurality of work stations whereat the ends of the cord are terminated with modular plugs. Each terminated end of the cord is grasped and forces are applied to pull the cord from the conveyor with the cord being in a U-shaped configuration. As this is done, a middle portion of the cord length is intercepted by a snagging pin. Movement of the plug ends is continued to extend the helices of the cord and to cause the cord to be aligned with a foldable tray. The plug ends are released whereupon the cord retracts and becomes disposed in the tray. The snagging pin is retracted to release the middle portion of the cord after which the tray is folded to form an opening in the lower end of the tray which is aligned with an open end of the container. The released cord descends under its weight through the opening in the tray and is received in the container. The folding of the tray serves to propel the cord into the container.

An apparatus for packaging cords which have been terminated at their ends with plugs as the cords are advanced through a plurality of work stations on a conveyor includes a pickup arm for grasping the plug-terminated ends of each cord. The pickup arm is moved outwardly from the conveyor to pull the cord from the conveyor. As this is done, a snagging pin intercepts the middle portion of the cord. The pickup arm continues to move to cause the helices of the cord to be extended. Then the pickup arm releases the ends of the cord whereupon the cord retracts and becomes disposed in a foldable tray comprising two hinged portions. A short cord in an extended condition is disposed in one portion of the foldable tray. On the other hand, a long cord is disposed across both portions of the tray. Then the snagging pin is retracted to release the cord and the tray is folded to provide an opening between its hinged portions. The cord descends under its own weight into an open end of a partially formed plastic bag connected to a supply strip. The folding of the tray is accomplished in a manner that accelerates the descent of the cord. The open end in the partially formed bag into which the cord has been dropped is sealed and the bag is separated from the supply strip.

BRIEF DESCRIPTION OF THE DRAWINGS

Other features of the present invention will be more readily understood from the following detailed description of specific embodiments thereof when read in conjunction with accompanying drawings, in which:

FIG. 10 is a plan view of a strip of plastic packaging material which is supplied to the apparatus of FIG. 9;

FIG. 11 is a side elevational view of the strip of plastic packaging material which is shown in FIG. 10;

FIG. 12 is a side elevational view of a portion of the packaging apparatus which is shown in FIG. 9;

FIGS. 15A, 15B, and 15C are a sequence of views which depict the operation of portions of the apparatus of FIG. 9 to package a cord that is received from the tray after the tray has been folded.

DETAILED DESCRIPTION

Figure 1:
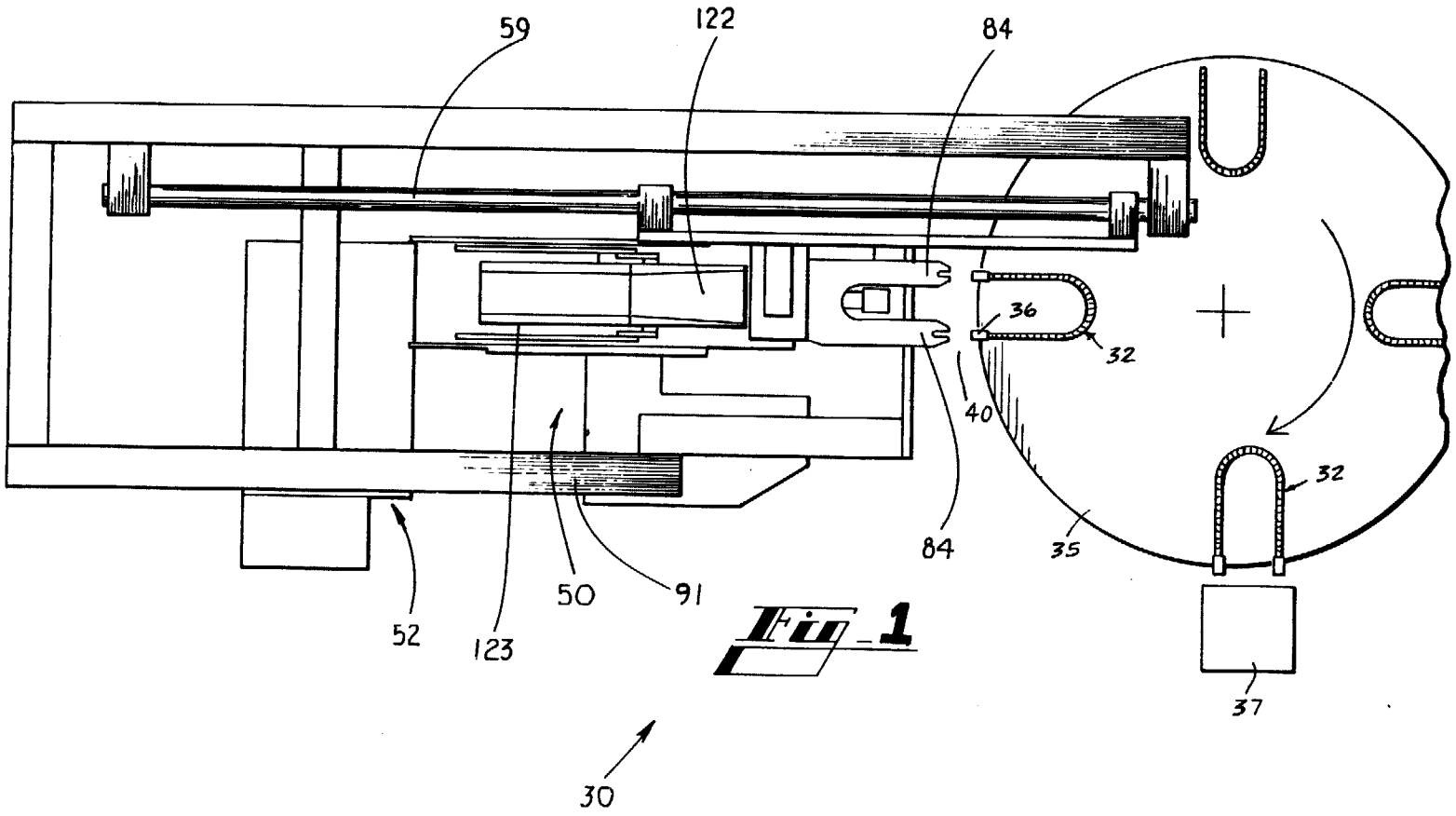
FIG. 1 is an overall plan view of an apparatus of this invention.

Referring now to FIG. 1, there is shown an apparatus which is designated generally by the numeral 30 for terminating and packaging telephone cords 32—32. Each of the cords 32—32 includes a length of cordage 34 which is wound in a plurality of convolutions, heat set and then removed from a mandrel in which it is wound while the direction of wind is reversed. Such a cord is shown in hereinbefore-identified U.S. Pat. No. 4,090,763.

The apparatus 30 includes a turntable 35 which is adapted to be turned rotatably through a plurality of work stations. In the apparatus 30, each cord 32 is terminated with a modular plug 36 such as that shown, for example, in hereinbefore-identified U.S. Pat. No. 4,148,539. The apparatus 30 includes facilities 37 such as those shown in U.S. Pat. No. 3,839,787 which issued on Oct. 8, 1974 in the names of W. B. Brown et al and which is incorporated by reference hereinto for inserting terminal blades into each of the plugs 36—36 that are secured to the ends of the cords.

Figure 2A:
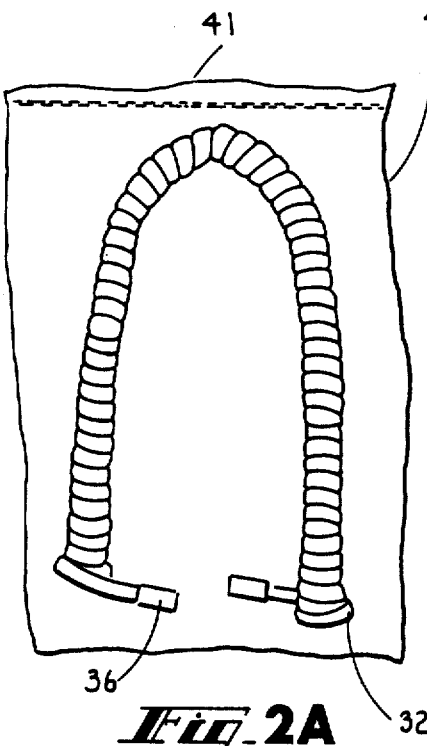
FIGS. 2A and 2B are views of a relatively short cord and of a relatively long cord in plastic containers.
Figure 2B:
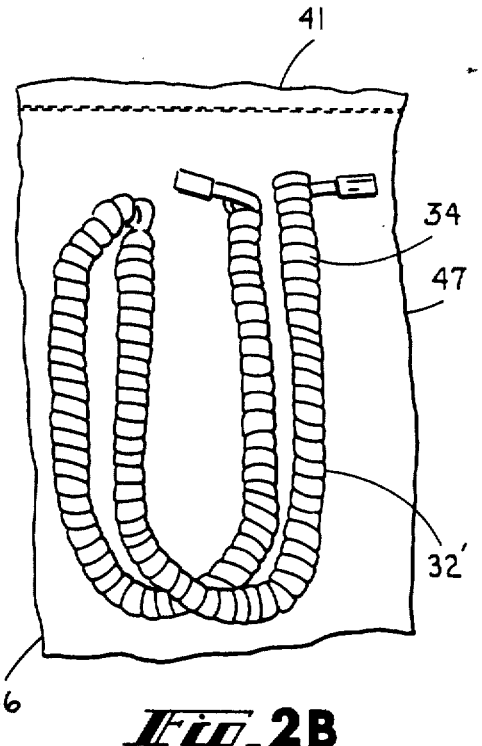

At a final work station 40 in the apparatus 30, each plug-terminated cord 32 is removed from the turntable 35 and is packaged. The packaged cord is depicted in FIG. 2. The cord 32 is disposed in a bag 41 such that it is folded into two halves of approximately equal length (see FIG. 2A). For a significantly longer cord 32', the cord is packaged in the same bag 41, but the cord is folded to provide four approximately equal length sections (see FIG. 2B).

The bag 41 comprises two plies which are made of a flexible packaging material such as polyethylene, polystyrene or pliofilms, for example. The plies are joined together along side portions 46 and 47 and are sealed together transversely between the side portions to hold the cord 32 within the bag.

Portions of a commercially available packaging apparatus as well as portions of the apparatus 30 which are used to transfer the cords to the packaging apparatus will be described herein. One such packaging apparatus is shown in U.S. Pat. No. 3,815,318 which is incorporated by reference hereinto. It should be noted that packaging apparatus other than that described herein may be used.

Figure 3:
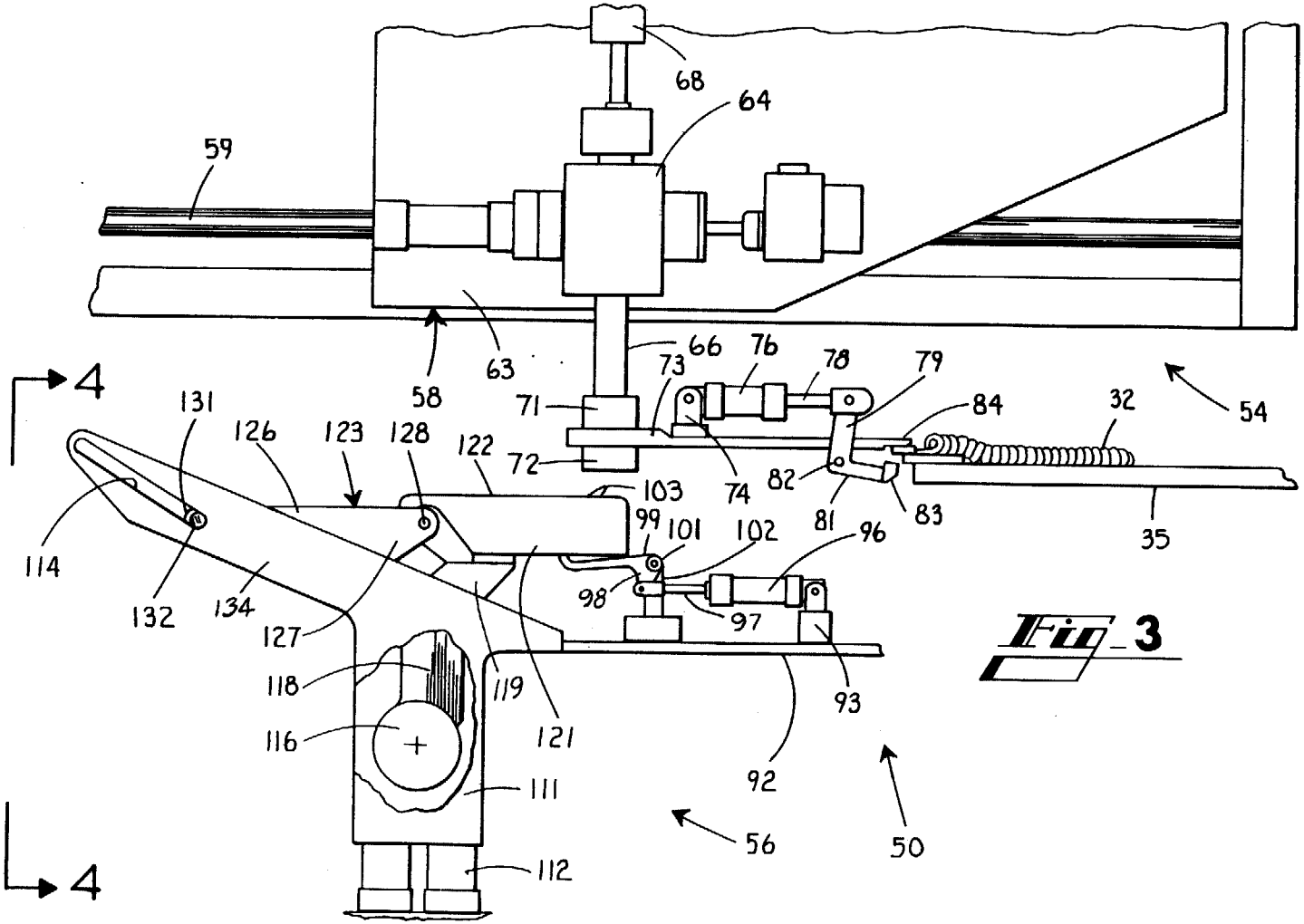
FIG. 3 is an elevational view of a transfer apparatus of this invention for removing terminated cords from a turntable and for feeding the cords to a packaging apparatus.

Referring now to FIG. 3, there is shown a portion 50 of the apparatus 30 which is used to remove each cord seriatim from the turntable 35 and to transfer it to packaging apparatus which is designated generally by the numeral 52. The portion 50 includes a pickup system 54 and a tray system 56.

The pickup system 54 includes a carriage 58 which is mounted for slidable movement along horizontally extending rods 59—59. The carriage 58 is moved from a first position where the pickup system 54 grasps each cord at the final station 40 on the turntable 35 to a retracted position by an air cylinder (not shown).

Figure 5:
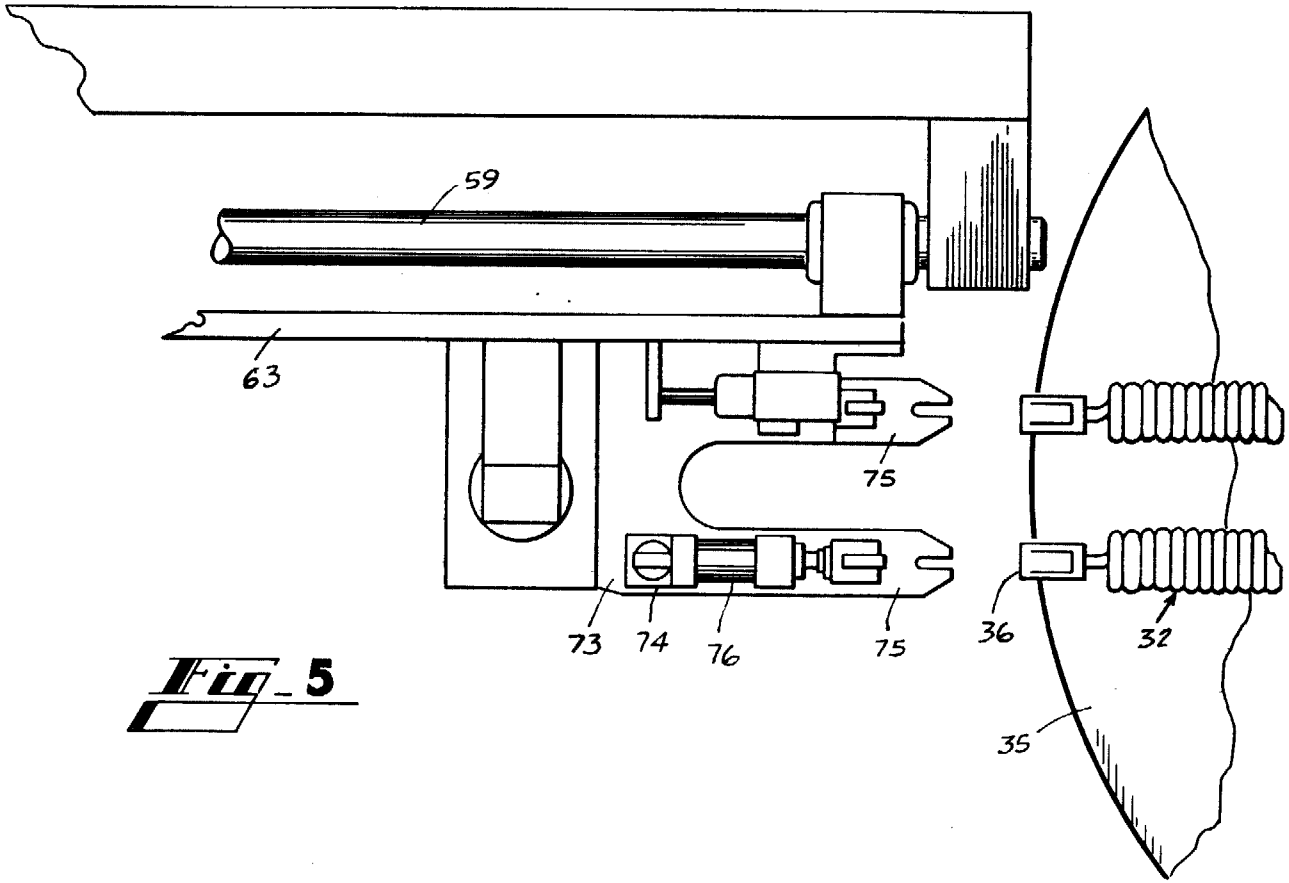
FIG. 5 is a plan view of a pickup arm portion of the transfer apparatus of FIG. 3.

The carriage 58 includes a vertically extending plate 63 on which is mounted a support block 64. Extending slidably through the block 64 is a rod 66 which is connected to an air cylinder 68. A lower end of the rod 66 is secured by collars 71 and 72 to a bifurcated member 73 (see FIGS. 3 and 5). Each furcation 75 supports a bearing 74 for mounting pivotably an air cylinder 76 having a rod 78 that is pinned to a portion 79 of an L-shaped crank 81. The crank 81 is adapted to be moved pivotally about a joint 82 to cause an end portion 83 to be aligned adjacent to or spaced from a free end 84 of the furcation 75. Extension of the rod 78 causes the end portion 83 to be moved clockwise as viewed in FIG. 3 and away from the free end 84 of an associated furcation 75. Retraction of the rod 78 causes counterclockwise rotation of the end portion 83 and its juxtaposition to the end 84.

Figure 4:
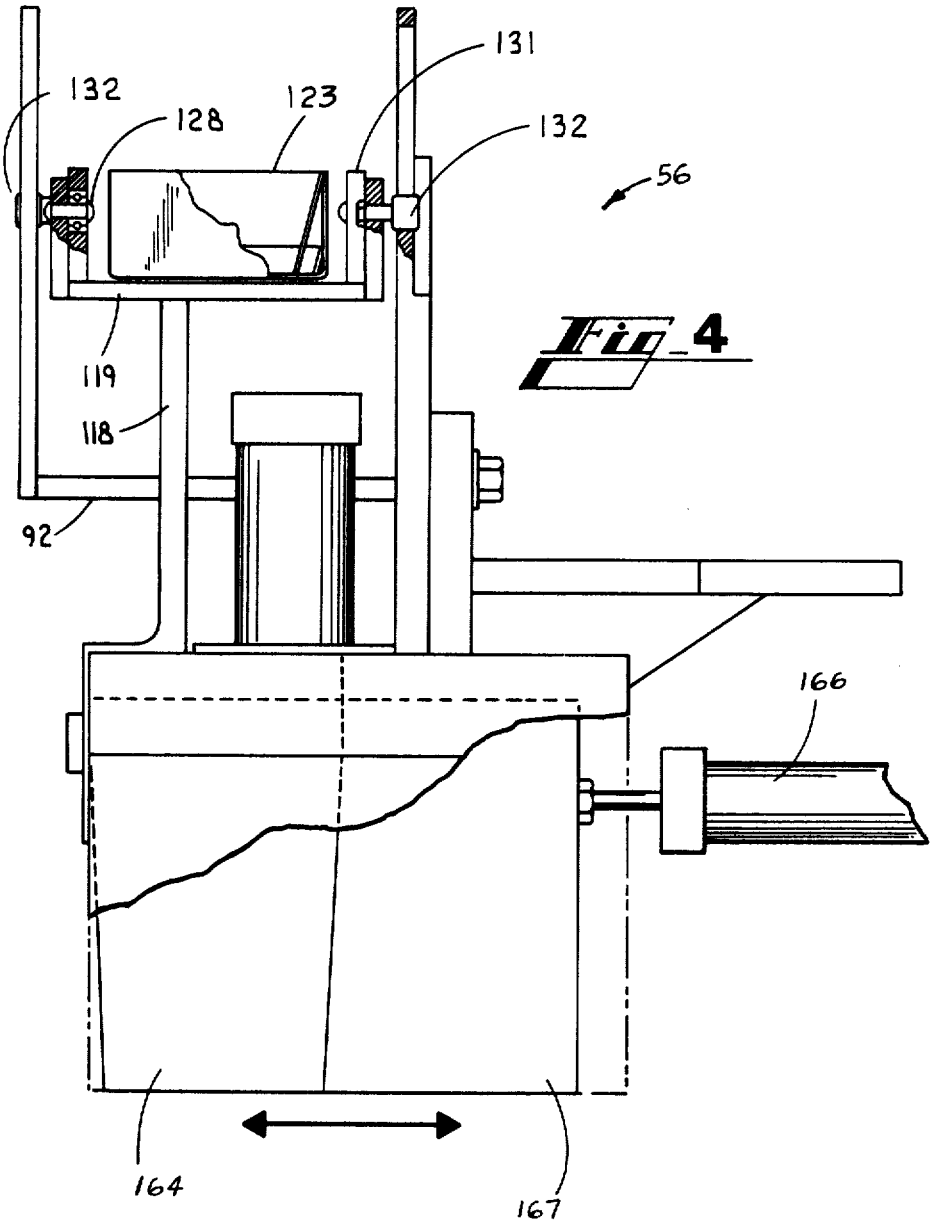
FIG. 4 is an end view of the transfer apparatus of FIG. 3 and taken along lines 4—4 thereof.

Suitably disposed below and to the left of the turntable 35 is the tray system 56 (see FIGS. 3 and 4). The tray system 56 is supported from a frame 91 (see also FIG. 1) that is attached to the framework of the turntable 35. It includes a member 92 on which is mounted a bearing 93 for supporting pivotally an air cylinder 96 (see also FIG. 6) having a rod 97 that is pinned to an end 98 of a snagging pin 99. The snagging pin 99 is mounted pivotally on a pin 101 that is supported in a stand 102. Extension of the rod 97 causes the snagging pin 99 to be turned clockwise about the pin 101 to move a snagging portion 103 upwardly. Retraction causes the portion 103 to be moved downwardly.

The tray system 56 also includes side support plates 111—111 that are connected to the plate 92 and that are mounted on supports 112—112 which are supported by the frame 91. Each of the plates 111—111 is provided with a cam slot 114. Extending between the side support plates 111—111 is a shaft 116 which is turned by a motor (not shown). Attached to the shaft 116 is a crank arm 118 that includes an end bracket 119 that is attached to sides 121—121 of one portion 122 of a foldable tray 123. A second portion 126 of the tray 123 has ends 127—127 that are connected through pins 128—128 to the bracket 119. Opposite ends 131—131 of the portion 126 are each provided with a pin 132 on each side thereof. Each pin 132 is received in one of the cam slots 114—114 of an extending portion 134 of the side plate 111.

Figure 7:
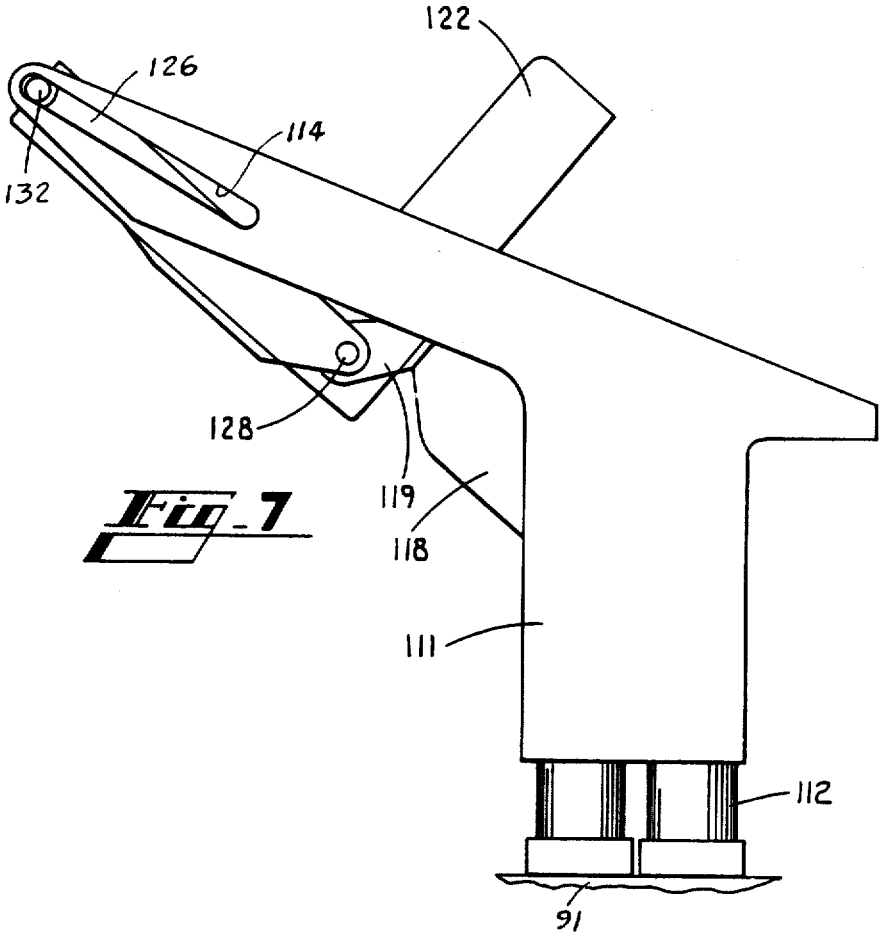
FIG. 7 is an elevational view of a tray portion of the transfer apparatus in a partially operated position.

When the crank arm 118 is oriented vertically, the tray portions are situated as depicted in FIG. 3. As the crank arm 118 is turned in a counterclockwise direction as viewed in FIG. 3, the pins 132—132 ride upwardly to the left in the cam slots 114—114 (see FIG. 7) and the portions of the tray begin to be folded. When the crank arm 118 is in a horizontal position, the pins 132—132 occupy the lowermost portions of the cam slots 114—114 and both portions of the tray 118 are substantially vertical (see FIG. 8). Moreover, in that position, the tray includes a generally rectangular opening 135 formed at its lower end between the two portions 122 and 126.

Figure 6:
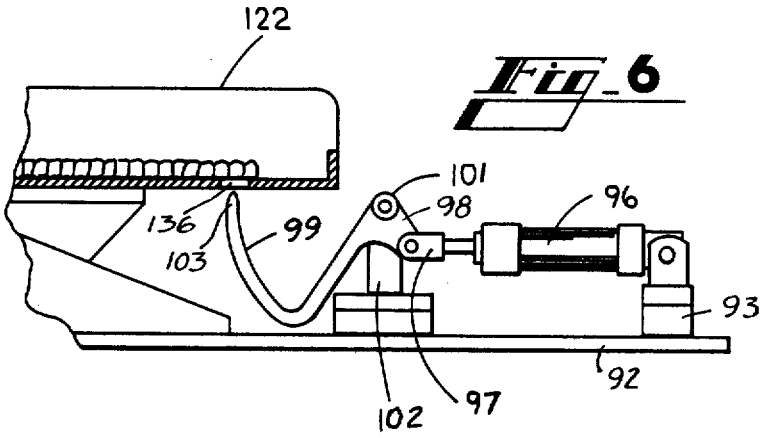
FIG. 6 is an elevational view of a snagging pin which comprises part of the transfer apparatus of FIG. 3.

Further, as can be observed from FIG. 6, the one portion 122 of the tray 118 includes a slot 136 through which the end 103 of the snagging pin 99 may protrude when the tray is in a generally horizontal position. As should be apparent, the snagging pin 99 is retracted prior to the folding of the tray 118.

Figure 9:
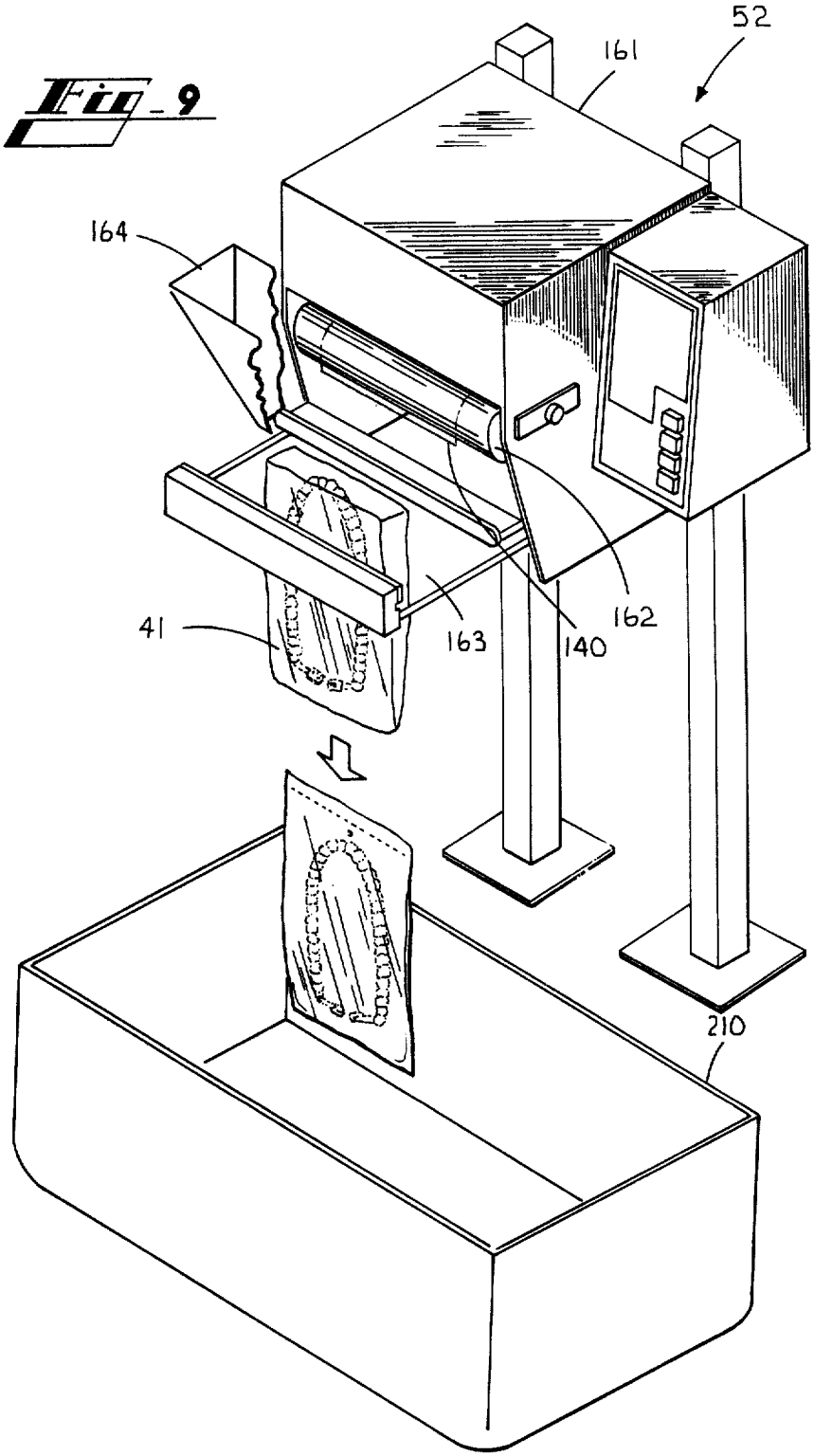
FIG. 9 is an elevational view of an apparatus which is adapted to receive cords from the transfer apparatus and to package each cord in a sealed plastic bag.

Going now to the apparatus 52 for packaging the cords 32—32, reference is made to FIG. 9. The bagging material is provided in a supply of a plastic strip 140 which comprises a pair of overlying plies and which includes a chain of containers in the form of the bags 41—41 which are interconnected. The bags 41—41 each have an opening in one ply with the other ply connected to a contiguous bag along a line of weakness.

More specifically, a supply strip 140 (see FIGS. 10 and 11) is formed by a first ply 141 and a second ply 142. The plies 141 and 142 are joined together along side portions of the strip. The strip 140 is provided with a plurality of transverse tearable portions 144 which are spaced along the length of the strip. The tearable portions may be formed by perforating the plies 141 and 142. The plies 141 and 142 are transversely sealed together in zones spaced along the length of the strip to provide a plurality of spaced sealed portions 146—146. Each tearable portion is adjacent to one of the sealed portions so that the tearable portions and sealed portions cooperate to divide the strip 140 into a series of the interconnected partially formed bags or containers 41—41. Each such bag has a closed end which is defined by a sealed portion 146 and an opposite end which is defined by the location of a tearable portion. The bags 41—41 are oriented in the same direction with the opposite end portion of each bag being connected by at least the ply 141 to the closed end portion of an adjacent bag. In addition the ply 141 is provided with a plurality of traversely formed slits 151—151 that are spaced along the length of the strip to provide access to the opposite end of each bag.

The packaging apparatus 52 include a cabinet 161 (see FIG. 9) for supporting the supply strip 140 of the interconnected bags. The supply strip 140 extends between feed rollers 162—162 (see FIG. 12). From the feed rollers 162—162, the strip 140 is fed downwardly to a loading station 163 where a terminated cord 32 is deposited in each successive bag.

In order to open each bag 41 which is fed into the loading station 163, a blower (not shown) is positioned within the cabinet 161. A duct connected to the blower is disposed adjacent to one side of the cabinet to direct air from the blower to a region of the loading station. Air is caused to flow over the upper feed roll 162 and downwardly along the surface of the strip 140. This causes air flow to open each bag 41 which is positioned in the loading station 163.

A loading chute 164 (see FIGS. 8 and 9) is provided between the lower end of the folded tray 123 and an open end of each bag for guiding the cords into a bag which is positioned in the loading station 163. The loading chute 164 is also referred to as a transition chute inasmuch as its upper end conforms to the rectangular opening 135 formed between the portions 122 and 126 of the folded tray 123 and its lower end conforms to a generally oval shaped open end of each bag 41.

The apparatus of this invention also includes provisions for periodically extracting a sample cord which is not packaged and which is subjected to quality control tests. The transition chute 164 is mounted to be moved reciprocally by an air cylinder 166 (see FIG. 4) which is controlled through a preset counter (not shown). In accordance with sampling instructions which are programmed into the preset counter, the air cylinder 166 is controlled to move the transition chute 164 and to insert a diverter gate 167 (see FIGS. 4 and 8A) into a position aligned with the opening 135 in the tray in its folded position. The diverter gate 167 is aligned with a sampling bin to cause the cord in the tray 123 to be guided into the sampling bin instead of being packaged.

A sealing and detaching assembly 169 (see FIG. 12) is provided for simultaneously sealing a cord-loaded bag and for separating each partially formed bag from the strip 140 while the bag is being sealed. A substantially vertically extending guard bracket 170 is provided rearwardly of the path of travel of the strip adjacent the loading station 163. A slot 171 is provided in the guard bracket 170 and a heater bar 172 is positioned within the region of the slot 171. A knife or gripper bar 173 having a toothed edge 174 is positioned above the heater bar 172 to protrude into the slot 171.

A sealing bar 175 is provided for clamping the plies of the bag 41 into engagement with each other with the inner face in engagement with both the heater bar 172 and the knife bar 173. A resilient pad 176 is carried by the sealing bar 175 to perform this clamping function.

The slotted guard bracket 170 facilitates the stripping of sealed containers from the heater bar and the sealer bar. Since the portion of the strip 140 being sealed must assume a generally U-shaped configuration upon insertion through the slot 171, the weight of the loaded bag 41 will tend to pull the bag outwardly and away from the heater bar and sealing bar at the completion of the sealing operation.

The sealing bar 175 is supported by a pair of support rods 178—178 which are journalled by a transversely extending bar 177 and by a pair of apertured brackets (not shown) within the cabinet 161. A transversely extending frame member 181 supports the brackets and hence the rods 178—178. An air controlled cylinder 182 which is supported by the transversely extending frame member 181 has a rod 183 thereof connected to the transversely extending bar 177. By this arrangement, the support rods 178—178 may be moved axially by the cylinder 182 to move the sealing bar 175 toward and away from the heating bar 172 and the knife or gripper bar 173. This frame 181 serves to support the sealing and detaching assembly 169 including the heater bar 172, the knife bar 173, and the sealing bar 175, and the air cylinder 182 for moving the sealing bar.

When the sealing bar 175 is in its outwardly extended position (see FIG. 12), the strip 140 with its integrally formed container 41 in the loading station 163 is positioned between the support rods 178—178. The bag 41 at that time is solely supported by its connection to the strip 140.

Figure 15A:
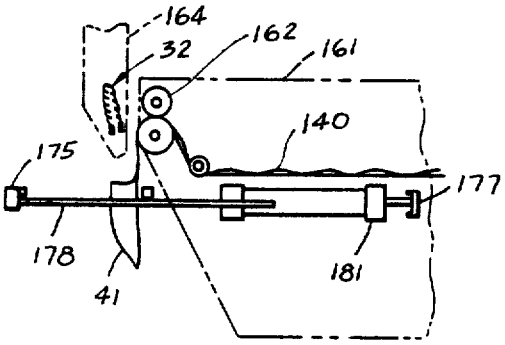

The sealing and detaching means 169 is pivotally mounted about a shaft 185, as is best seen in FIGS. 12 and 15C. The shaft 185 is journalled through collars of the frame 181 and a pair of transversely extending brackets 186—186 which are supported by a stationary frame 187. By this arrangement, the frame 181 through which the rods 178—178 and the rod 185 extend is pivotally mounted about the shaft 185 which is supported by the stationary frame 187.

A second air cylinder 195 (see FIG. 15C) is provided for moving the frame 181 and hence the sealing and detaching assembly 169 about the shaft 185. The air cylinder 195 connects at one end with the frame 187, and at the other end with a bracket 196. The bracket 196, in turn, connects with a side member 191 of the frame 181.

A stripper bar 200, as best seen in FIG. 12, is pivotally mounted about an axis 201 from the guard bracket 170. A spring 202 biases the stripper bar against the front surface of the guard bracket 170. A magnet (not shown) carried by the sealing bar 175 serves to snap the stripper bar outwardly when the sealing bar moves outwardly from its fully inward position. By this arrangement, the stripper bar serves to disengage sealed, partially formed bags 41—41 from the heater bar 172 and knife bar 173.

In the operation of the apparatus 30, an operator loads cords comprising lengths of retractile cordage 34 having unterminated ends into nests on the turntable 35 as the turntable is indexed through a plurality of work stations. Each length is in a generally U-shaped configuration. As each of the cords is indexed through the work stations, each of its ends is terminated with a modular plug 36. Each terminated cord 32 is moved into the unloading station 40 whereat it is removed from the turntable 35 and transferred to the packaging apparatus 52.

After a cord 32 has been moved into the station 40, the pickup system 54 is controlled to be moved to remove the cord from the turntable. The carriage 58 is moved along the rods 59—59 until each of the furcations 75—75 and its associated pawl end 83 are juxtaposed to one of the plugs 36—36. Then the cylinder 76 is controlled to extend its rod and move pivotally the crank 81 about the joint 82. This causes each pawl end 83 to be moved upwardly to clamp a plug 36 in engagement with its associated furcation 75 (see FIG. 3). Then the carriage 58 is caused to be moved to the left as viewed in FIG. 3 to pull the cord from the turntable 35.

Figure 13:
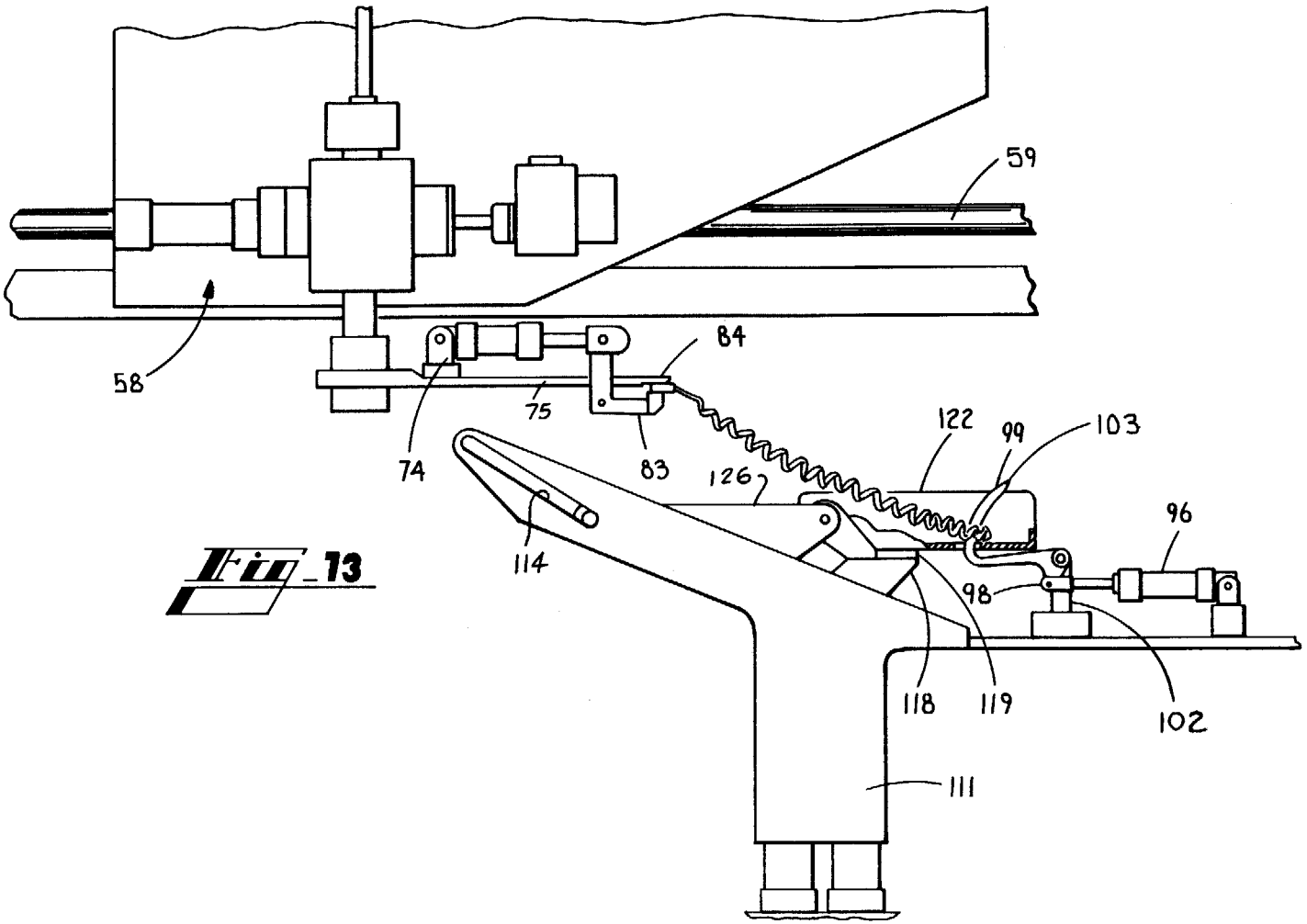
FIG. 13 is an elevational view of the transfer apparatus of FIG. 3 which shows a cord removed from the turntable and being intercepted by the snagging pin.

The next sequence of steps cause the cord 32 to be disposed in the tray 123. Preparatory to the cord 32 being pulled from the conveyor 35, the air cylinder 96 is controlled to move the free end 103 of the snagging pin in a clockwise direction to cause it to protrude through the opening 136 in the tray portion 122 (see FIG. 3). As the carriage 58 continues to move to the left as viewed in FIG. 13, a middle portion of the cord 32 which is unsupported is intercepted by the snagging pin 99. Further movement of the carriage 58 causes the cord helices to be extended. Following this, the air cylinders 76—76 are caused to be operated to move the pawl ends from the furcations 75—75 to release the plugs 36—36. As a result, the cord 32 is released, its helices are retracted and it is deposited in the tray 123 (see FIG. 14). Then the air cylinder 96 is controlled to move the free end 103 in an opposite direction and retracted through the tray slot 136 (see FIG. 6).

Figure 14A:
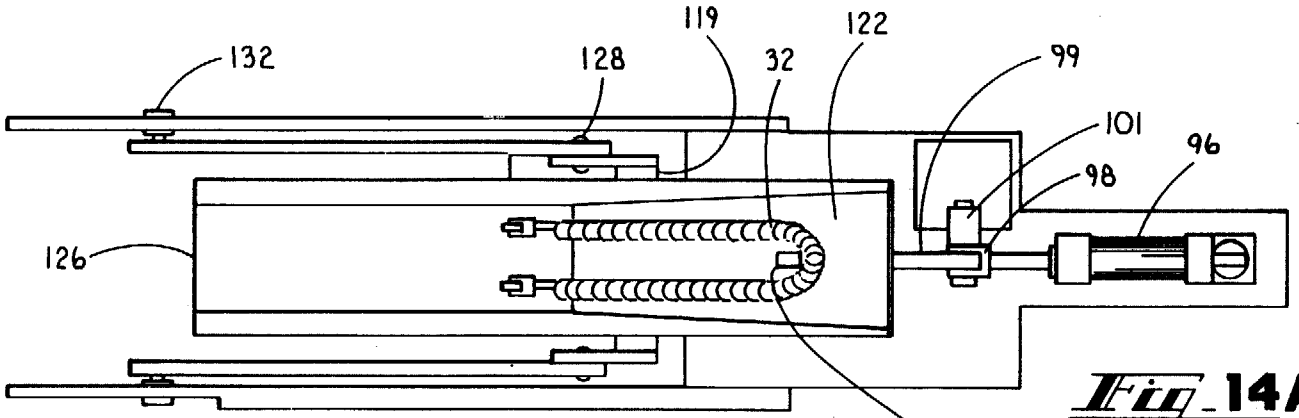
FIGS. 14A and 14B are plan views of the tray in an unoperated position with short and long cords, respectively, disposed therein.
Figure 14B:
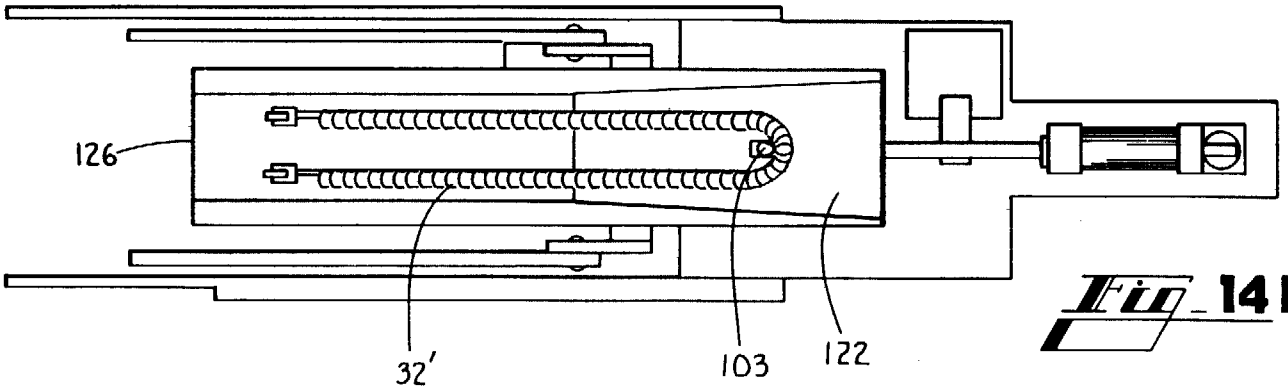

Going now to FIGS. 14A and 14B, it can be seen that the deposition of the cord 32 in the tray 123 differs as a function of the cord length. For a relatively short length, the cord 32 is disposed generally in the tray portion 122. When released, the cord 32' having a longer length is disposed in the tray portion 122 and in the portion 126 (see FIG. 14B).

Next, the tray 123 is caused to be folded. The shaft 116 is moved rotatably to turn the crank arm 118. This causes the pins 132—132 to ride upwardly to the left in the cam slots 114—114 (see FIG. 7). At the same time, the two tray portions 122 and 126 assume positions shown in FIG. 7. Continued turning of the crank arm 118 results in a vertical orientation of the tray portions 122 and 126 whereupon the opening 135 is formed between their lower ends (see FIG. 8).

Viewing again FIG. 14A it should be appreciated that as the tray 123 is folded, a short length cord 32 is caused to be moved through the opening 135 between the tray portions with the plugs being at a lower end of the cord. The vertical orientation of the tray portions with the opening therebetween allows the cord to descend under its own weight. This movement is supplemented by the movement of the tray portions into their vertical orientation by the turning of the crank arm. This serves to propel the cord 32 or 32' toward the aligned plastic bag. On the other hand, for the longer cord 32' of FIG. 14B, its disposition across the two tray portions causes the cord to be doubled over with the plugs oriented upwardly as the tray is folded. As a result, the cord 32' of FIG. 14B assumes the orientation shown in FIG. 2B.

Figure 15B:
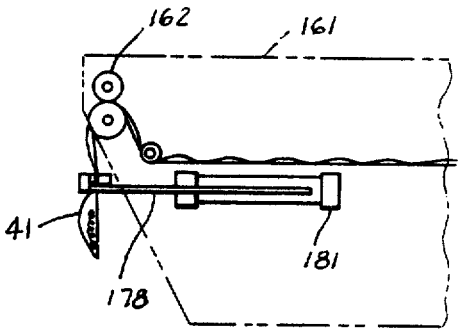
Figures 8, 8A:
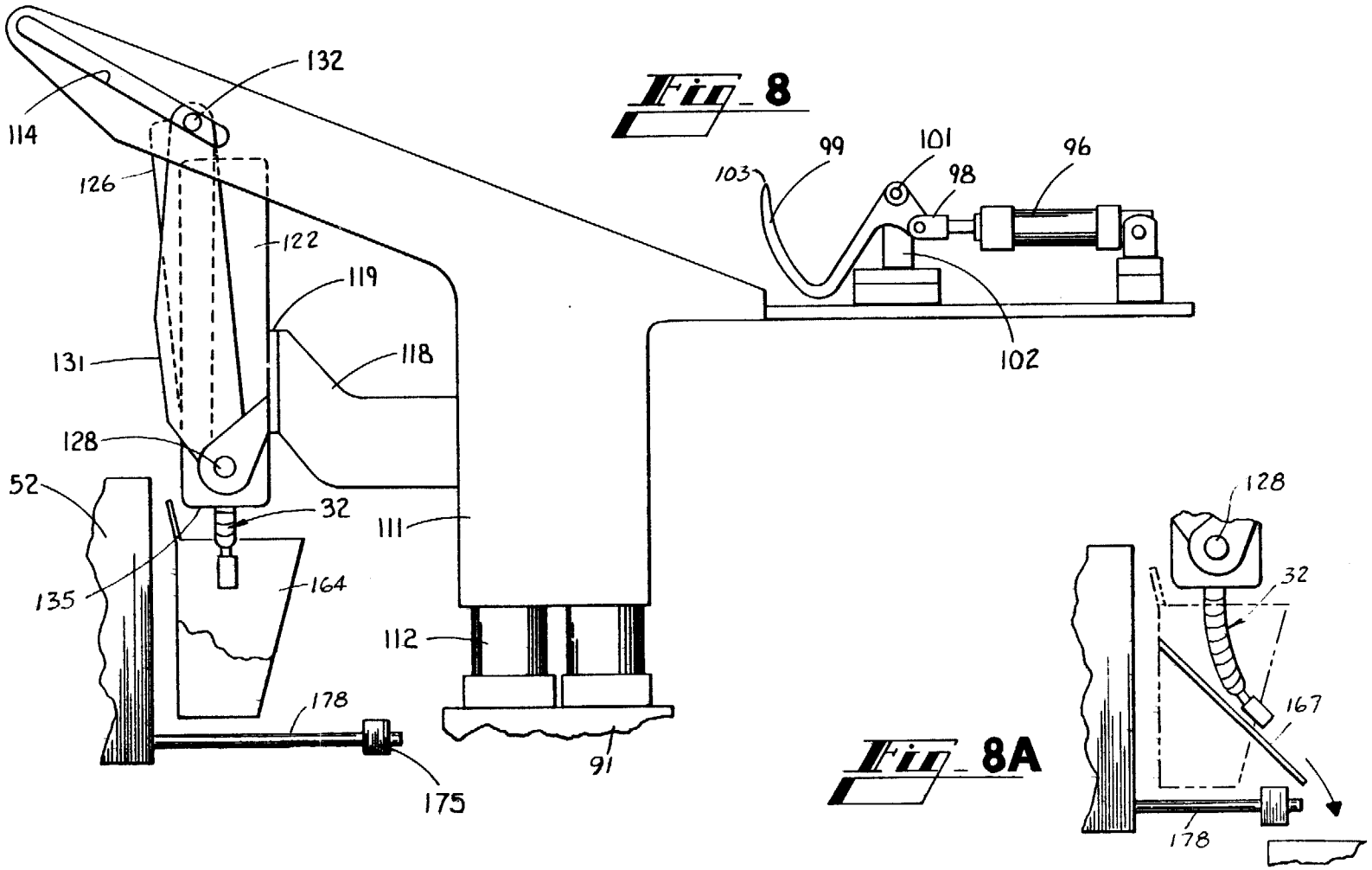
FIG. 8 is an elevational view of the tray system of FIG. 7 in a fully operated position with a transition chute connecting an opening in the folded tray with an open end of a plastic container.
FIG. 8A is a detail view of a portion of FIG. 8 to show the transition chute replaced with a diverter gate for obtaining a cord sample.

The tray 123 is situated to cause the opening 135 between the folded portions to be aligned vertically with the chute 164 of the packaging apparatus 52 (see FIG. 8). The strip 140 is initially fed between the feed rolls 162—162. After the leading one of the partially formed bags 41—41 is advanced to the loading position 163 and opened as illustrated, a cord 32 is discharged through the loading chute 164 into the open bag. The sealing bar 175 is then drawn inwardly as shown in FIG. 15B to clamp both sides of the bag 41 into engagement with the heater bar 172 and the knife bar 173. The heater bar 172 then seals the container 41 while the toothed edge 174 of the knife bar 173 punctures the strip 140 across the plastic surface above the region of the heat seal. As soon as the pad 176 carried by the sealing bar 175 has clamped the container 150 against the heating bar 172 and the knife bar 173, the air cylinder 195 is controlled to extend its piston rod to pivot the sealing and detaching assembly about the shaft 185 as illustrated in FIG. 15C. A tearing action is provided with the separation of the bag 41 being along a preformed line of weakness in the strip 140. The coaction of the knife gripper bar 173 and the pad 176 gripping the bag 41 between the newly formed seal and the line of weakness assure that the separation is along this line rather than elsewhere along the strip 140.

With the sealing and detaching assembly in the downwardly pivoted position (see FIG. 15C), the air cylinder 182 is then retracted. The action draws the stripper bar 200 outwardly to strip the sealed bag 41 away from the region of the heating bar 172 and the knife bar 173. The sealed bag 41 is then free to drop into a suitable receptacle 210 (see FIG. 9) which may be provided beneath the packaging station.

The sealing and detaching assembly, with the sealing bar in its extended position, is then returned by the air cylinder 195 to its sealing position. At the same time an electrical control means (not shown) operates a motor and advances the strip 140 to position the next successive bag in the loading station 163 with its open end oriented upwardly to receive the next successive cord.

It is to be understood that the above-described arrangements are simply illustrative of the invention. Other arrangements may be devised by those skilled in the art which will embody the principles of the invention and fall within the spirit and scope thereof.

What is claimed is:

1. A method of packaging a terminated retractile cord, said method including the steps of:

positioning a retractile cord on a conveyor with ends of the cord adjacent to an edge of the conveyor;

moving the cord through a plurality of work stations:

terminating each end of the cord with a modular plug;

grasping each plug of the cord;

applying forces to the plugs of the cord to remove the cord from the conveyor with the cord being disposed in a U-shaped configuration;

intercepting a middle portion of the length of the cord;

continuing to move the plugs to extend the helices of the cord;

moving a container into a loading station;

releasing the plugs of the cord to cause portions of the cord to be received in a horizontally disposed tray; then releasing the middle portion of the cord; and turning the tray to cause it to be oriented substantially vertically with a lower end thereof aligned with an open end of the container in the loading station and to cause the cord to be moved into the container.

2. The method of claim 1, wherein said step of turning the tray is accomplished in a manner which propels the cord into the container.

3. The method of claim 1, wherein the cord is released when its plugs are substantially adjacent to an end of the tray that is destined to become the lower end when the tray is turned to cause the plug ends of the cord to be adjacent to the bottom of the container which is opposite to the open end.

4. The method of claim 1, wherein the tray comprises two portions which are substantially coplanar when the cord is received therein, the tray being foldable about a hinged joint between the two portions to provide an opening between the two portions, and wherein the cord is released when the plugs are spaced from the hinged joint with the cord spanning both portions whereupon the folding of the tray causes the cord to be folded to position the plugs adjacent to the middle portion of the cord and oriented toward the open end of the container when the cord is received in the container.

5. The method of claim 1, wherein a supply strip includes a plurality of partially formed plastic bags interconnected together with each partially formed bag including an open end, and wherein the tray is foldable to provide an opening at its lower end, and said method also includes the step of causing the open end of each successive bag to be disposed below the opening provided at the lower end of the folded tray to allow insertion of the cord into the bag, and wherein subsequent to the deposition of the cord in the bag, the method includes the step of forming a transverse seal adjacent to the open end of the bag to provide a sealed container for the cord.

6. A method of transferring a retractile cord from a holder into an open end of a container, said method comprising the steps of:

grasping ends of the cord;

moving the cord outwardly from the holder with the cord being in a generally U-shaped configuration;

intercepting a middle portion of the length of the cord;

continuing to apply pulling forces to the cord ends to extend the helices of the cord;

releasing the ends of the cords to cause the cord to be received in a horizontally disposed tray;

releasing the middle portion of the cord; and turning the tray to cause it to be oriented substantially vertically with a lower end thereof aligned with an open end of the container and to cause the cord to be moved into the container.

7. The method of claim 6, wherein said step of turning the tray is accomplished in a manner which propels the cord into the container.

8. The method of claim 6, wherein the tray includes two portions which are substantially coplanar, the tray being foldable about a hinged joint between the two portions to provide an opening between their lower ends.

9. The method of claim 8, wherein the movement of the cord ends is discontinued with the ends of the cord being aligned generally with the hinged joint so that when the tray is folded, the cord is disposed in two portions of substantially equal length.

10. The method of claim 8, wherein the movement of the cord ends is discontinued with the ends of the cord being disposed in one portion of the foldable tray and the middle portion of the cord being intercepted in the other portion so that when the tray is folded, the cord is folded to be disposed in four sections of substantially equal length.

11. Apparatus for packaging a terminated retractile cord in a container, said apparatus including:

holding means including a conveyor for supporting a cord with ends of the cord adjacent to an edge of said conveyor and for moving the cord through a plurality of work stations;

means positioned at one of the work stations for terminating each end of the cord with a modular plug;

packaging means adjacent to said conveyor for providing a container having an open end at a loading station to package the cord; and transferring means positioned at another one of the work stations for moving the cord from the conveyor to said packaging means, said means including:

means for grasping the plugs;

means for applying forces to the plugs to cause the cord to be removed from the conveyor with the cord being disposed in a generally U-shaped configuration;

means for intercepting a middle portion of the length of the cord as it is removed from the conveyor to cause the helices of the cord to be extended;

foldable tray means disposed below the cord for receiving the cord, said tray means including an opening at a lower end thereof when said tray means is disposed in a folded postion; and means for causing said transferring means to release said plugs and for then causing the middle portion of the cord to be released and said tray means to be folded to align said opening thereof with the open end of the container in the loading station whereupon the cord is moved through said opening and into the container.

12. The apparatus of claim 11, wherein said causing means causes said tray to be folded in a manner which propels the cord into the container.

13. The apparatus of claim 11, wherein said packaging means includes means for positioning a plastic bag having an open end below said tray means, with the open end of the bag aligned with said opening in said tray means when said tray means is in a folded position.

14. The apparatus of claim 11, wherein said transferring means includes a carriage, wherein said means for grasping the plugs and for applying forces to the plugs are mounted on said carriage for movement outwardly from said conveyor, and wherein said tray means comprises two portions one of which is provided with a slot, said intercepting means including a snagging pin which is adapted to be moved through said slot into said one portion of said tray to intercept the middle portion of the cord and retractably through said slot to release the middle portion of the cord.

15. The apparatus of claim 14, wherein for a relatively short cord, said movement of said carriage is adapted to be discontinued when said grasping means is substantially aligned with an axis about which said portions of said tray means are folded.

16. The apparatus of claim 14, wherein for a relatively long cord said movement of said carriage is adapted to be discontinued when said grasping means is aligned above an outermost portion of said tray means to cause the cord to be folded and disposed in four approximately equal length sections when said tray means is folded.

17. Apparatus for transferring a retractile cord from a holder into an open end of a container, said apparatus including:

means for grasping the cord ends;

means for moving said grasping means to cause the cord to be moved outwardly along a path of travel from the holder with the cord in a generally U-shaped configuration;

means for intercepting a middle portion of the cord length to cause the helices of the cord to be extended as the cord ends are moved farther outwardly from the holder;

a tray disposed beneath the path of travel of the cord, said tray including two portions which are connected together in a manner which allows said tray to be folded to orient said portions substantially vertically, said portions when oriented vertically providing an opening at the lower ends thereof with said opening being aligned with an open end of the container; and means for causing said grasping means to release said plugs, for causing said intercepting means to become disengaged from the cord, and for causing said tray to be folded to allow the cord to be moved through said tray opening into the aligned open end of the container.

18. The apparatus of claim 17, wherein said tray includes a first portion adjacent to said holder and a second portion spaced therefrom, said first portion including a slot therein.

19. The apparatus of claim 18, wherein said means for intercepting the cord includes a snagging pin which is adapted to be moved through said slot in said first portion of said tray to intercept the cord and to be retracted through said slot.

20. The apparatus of claim 17, wherein said means for causing said tray to be folded accomplishes the folding in a manner which propels the cord into the container.

* * * * *